US009057475B1

(12) United States Patent
Macfarlane

(10) Patent No.: US 9,057,475 B1
(45) Date of Patent: Jun. 16, 2015

(54) BEACH UMBRELLA WITH TELESCOPING POLE AND BASE PLATE

(71) Applicant: Jack Macfarlane, Oshawa (CA)

(72) Inventor: Jack Macfarlane, Oshawa (CA)

( * ) Notice: Subject to any disclaimer, the term of this patent is extended or adjusted under 35 U.S.C. 154(b) by 90 days.

(21) Appl. No.: 13/849,992

(22) Filed: Mar. 25, 2013

(51) Int. Cl.

| | |
|---|---|
| ***A45B 25/00*** | (2006.01) |
| ***A45B 3/00*** | (2006.01) |
| ***F16M 13/00*** | (2006.01) |
| *A45B 23/00* | (2006.01) |

(52) U.S. Cl.
CPC ..... *F16M 13/00* (2013.01); *A45B 25/00* (2013.01); *A45B 2023/0012* (2013.01)

(58) Field of Classification Search
CPC ..... A45B 3/00; A45B 5/00; A45B 1/00; A45B 2023/0012; F16M 13/00; F16M 13/02; F16M 2200/08; E04H 12/2238; E04H 12/2215; E04H 12/2261
USPC ..... 135/15.1, 16, 98, 902, 34.2; 248/156, 248/545, 519, 523, 530, 533, 218.4; 108/50.11, 50.12
See application file for complete search history.

(56) References Cited

U.S. PATENT DOCUMENTS

| | | | | | |
|---|---|---|---|---|---|
| 1,218,357 | A * | 3/1917 | Bauer | 108/158 |
| 3,225,656 | A * | 12/1965 | Flaherty et al. | 89/37.04 |
| 3,415,475 | A * | 12/1968 | Goodman | 248/158 |
| 3,811,455 | A | 5/1974 | Thur | |
| 3,843,079 | A * | 10/1974 | Reisling | 248/530 |
| 4,687,012 | A | 8/1987 | Schultes et al. | |
| 4,850,564 | A * | 7/1989 | Padin | 248/533 |
| 4,942,962 | A * | 7/1990 | Jordan | 206/315.7 |
| 5,207,406 | A | 5/1993 | Stine et al. | |
| 5,271,196 | A * | 12/1993 | Fanti | 52/166 |
| 5,593,239 | A | 1/1997 | Sallee | |
| 5,720,311 | A | 2/1998 | Lin et al. | |
| 6,354,554 | B1 | 3/2002 | Hollenbeck | |
| 6,866,053 | B2 | 3/2005 | You | |
| 6,953,180 | B1 * | 10/2005 | Ruvalcaba et al. | 248/530 |
| 7,380,561 | B2 | 6/2008 | Nobert et al. | |
| 7,980,520 | B2 * | 7/2011 | Taylor | 248/156 |
| D655,531 | S | 3/2012 | Gharst | |
| 8,191,562 | B1 | 6/2012 | Sampson | |
| 2002/0023996 | A1 * | 2/2002 | Kondash | 248/520 |
| 2006/0054206 | A1 * | 3/2006 | Bilotti | 135/16 |
| 2010/0200724 | A1 * | 8/2010 | Kukuk | 248/530 |
| 2013/0206954 | A1 * | 8/2013 | Wells et al. | 248/523 |

* cited by examiner

*Primary Examiner* — Winnie Yip
(74) *Attorney, Agent, or Firm* — Robert C. Montgomery; Montgomery Patent & Design, LLC

(57) ABSTRACT

A support stand for a beach umbrella or similar structure that requires support is described. The support stand includes a base plate having an upwardly extending attachment cylinder for receiving a pole of an item the needs support. The bottom of the support stand includes a plurality of pivotally attached projections for extending into the ground to provide support. The projections are biased open but can be selectively folded flat against the bottom of the support stand and then held in place for transportation or storage. The support stand includes a handle and pole attachment features the enable one handed transportation.

18 Claims, 3 Drawing Sheets

BEACH UMBRELLA WITH TELESCOPING POLE AND BASE PLATE

RELATED APPLICATIONS

There are no current co-pending applications.

FIELD OF THE INVENTION

The presently disclosed subject matter is directed towards a beach sun shades. More particularly the present invention relates to beach umbrellas having base plates with pivotal projections for securing in the beach umbrella in place.

BACKGROUND OF THE INVENTION

Very few leisure time activities can rival spending a warm summer day at the beach. The sun, sand, relaxation, time with family and friends make the beach very popular. However, at times the sun and the heat it produces can be overwhelming.

To block the sun many people use beach umbrellas. Beach umbrellas not only provide sun protection but privacy as well. While beach umbrellas have proven very successful they are not without problems. As is well known beach umbrellas are prone to becoming dislodged, falling over, getting blown away, and become hazards. Such actions often damage umbrellas beyond repair, requiring costly replacement. Even slight breezes can create problems.

The tendency for beach umbrellas to pull out of the sand is aggravated by not inserting the umbrella far enough. Pushing an umbrella poll into the sand can be difficult even for those that have great physical strength. In addition umbrella surface areas, sand textures, sand moisture, and wind all tend to pull umbrellas out of the sand over time.

Accordingly, there exists a need for a device by which beach umbrellas can be firmly fastened into sand to withstand windy conditions. Preferably such a device would not require great physical strength, pounding into the sand, or even tools. Beneficially such device would enable beach umbrellas to be used in different sand conditions, environmental conditions, and the like. Ideally such devices would be useful with a range of beach umbrellas and would incorporate a mechanism for easily attaching a beach umbrella. Such a device that prevents loss and damage to beach umbrellas would be particularly useful.

SUMMARY OF THE INVENTION

The principles of the present invention provide for a support system for attaching beach umbrellas or similar structure to sand so as to withstand windy conditions.

A support system in accord with the present invention includes a support base with a top and a bottom and an attachment sleeve that extends from the top. An attachment fastener passes through the support base to retain the attachment sleeve in place. The system further includes first and second triangular-shaped appendage for penetrating into a grade. The first and second triangular-shaped appendages are hinged mounted by first and second hinges to the bottom of the support base. In practice the attachment fastener can pass through the center of the support base while a pole fastener, such as a thumbscrew, is threaded into the side of the attachment sleeve.

The first triangular-shaped appendage is beneficially about four inches (4 in.) wide at the base, one inch (1 in.) wide at the tip, and approximately four-and-a-half inches (4½ in.) along each angled side, while the support base is beneficially circular. The support base preferably includes a hanging hook near its perimeter as well as a carrying handle. In practice the support system will further include a third triangular-shaped appendage; a fourth triangular-shaped appendage, a third hinge assembly attaching the third triangular-shaped appendage to the bottom, and a fourth hinge assembly attaching the fourth triangular-shaped appendage to the bottom. The support system is particularly useful for supporting a beach umbrella having a lower support tube, a canopy, a height adjustment system, and an angle adjustment system. In use the lower support tube is inserted into the attachment sleeve.

Another support system in accord with the present invention includes a support base having a top and a bottom and an attachment sleeve that extends from the top. An attachment fastener passes through the support base to retain the attachment sleeve in position. The support system further includes a first triangular-shaped appendage, a second triangular-shaped appendage, a third triangular-shaped appendage, a fourth triangular-shaped appendage, a first hinge assembly attaching the first triangular-shaped appendage to the bottom, a second hinge assembly attaching the second triangular-shaped appendage to the bottom, a third hinge assembly attaching the third triangular-shaped appendage to the bottom, and a fourth hinge assembly attaching the fourth triangular-shaped appendage to the bottom. An attachment fastener passes through the center of the support base, while a pole fastener threads into a side of the attachment sleeve. Beneficially the pole fastener is a thumbscrew and the support base is substantially circular.

Preferably the support base includes a hanging hook near its perimeter, a carrying handle, and a pair of fastening clamps. The support base can work with a beach umbrella having a lower support tube, a canopy, a height adjustment system, and an angle adjustment system. In that case the lower support tube is inserted into the attachment sleeve.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
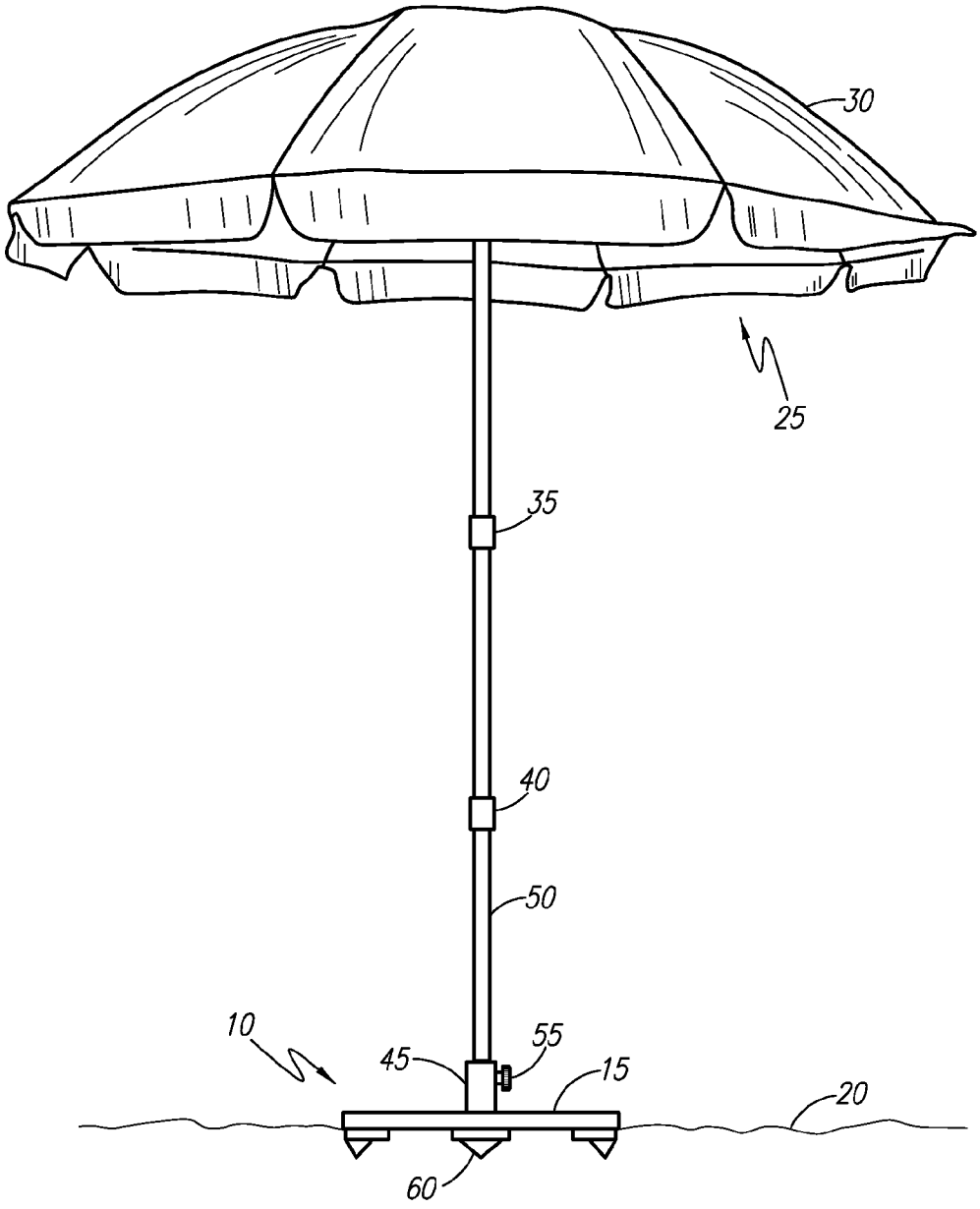
FIG. 1 is a side view of a support system 10 for beach umbrellas 30 that is in accord with the preferred embodiment of the present invention.

10 surface support system for beach umbrellas
15 support base
20 grade
25 beach umbrella
30 canopy
35 height adjustment system
40 angle adjustment system
45 attachment sleeve
50 lower support tube

55 securing fastener
60 triangular-shaped appendage
65 hinge assembly
70 attachment fastener
75 hanging hook
80 carrying handle
85 fastening clamp
90 base mounting bracket
95 appendage pivot
100 spring assembly
105 release lever
110 first travel path arrow
115 second travel path arrow
120 opening
125 upper opening

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

FIG. 1 presents a side view of a support system 10 used to support a beach umbrella 25 according to the preferred embodiment of the present invention. The support system 10 includes a support base 15 which rests upon a grade 20 such as sand, dirt, grass, gravel, rock or the like. The support base 15 supports the beach umbrella 25, which has a conventional design. The beach umbrella 25 includes a canopy 30, a height adjustment system 35 and an angle adjustment system 40. While FIG. 1 shows a beach umbrella 25 it should be noted that other similar structures such as a dining canopy, an awning, a tent, or the like also could benefit from the support system 10. As such it should be understood that the present invention is not necessarily restricted to use with beach umbrellas 25. However, beach umbrellas 25 can clearly benefit from the present invention.

The support system 10 includes an attachment sleeve 45 for holding a lower support tube 50. The lower support tube 50 is retained in the attachment sleeve 45 by a securing a fastener 55 such as a threaded thumbscrew. The securing fastener 55 and the attachment sleeve 45 provide a strong physical connection that ensures that the lower support tube 50 and subsequently the beach umbrella 25 will not become dislodged from the support base 15 by wind or other forces.

Figure 2:
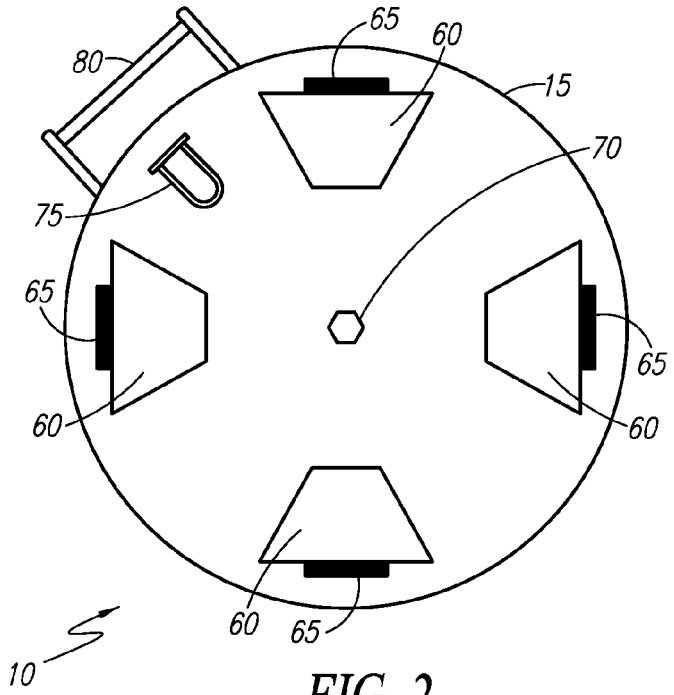
FIG. 2 is a bottom view of a support base 15 used with the support system 10 shown in FIG. 1.

Referring now to FIG. 2, a bottom view of the support base 15, the support base 15 is envisioned as being approximately ten to twelve inches (10-12 in.) in diameter. However, larger and smaller versions could be produced. Thus the specific size is not intended to be a limiting factor of the invention.

Referring to FIGS. 1 and 2, the bottom of the support base 15 includes a plurality of triangular-shaped appendages 60 which penetrate into the grade 20 for additional holding power. The triangular-shaped appendages 60 (four (4) shown in the preferred embodiment) are shown in FIG. 2 folded or stowed state to allow for ease of storage and transport, while FIG. 1 shows them extended. The folding capability is provided by a hinge assembly 65 at each of the triangular-shaped appendages 60.

Each triangular-shaped appendage 60 is envisioned as being approximately four inches (4 in.) wide at the base, one inch (1 in.) wide at the tip, and approximately four-and-a-half inches (4½ in.) along each angled sides. An attachment 70, such as a bolt, passes through the center of the support base 15. The attachment 70 is used to fasten the attachment sleeve 45 (as shown in FIG. 1) to the support base 15. Additionally, the support base 15 includes a hanging hook 75 near the edge of the support base 15. The hanging hook 75 is used to hang the support base 15 from a standard wall hook for storage. Finally, the support base 15 includes a carrying handle 80 to facilitate carrying the support base 15.

It is envisioned that the support base 15 is made of heavy, dense and strong material such as steel, iron, possibly aluminum, or even a heavy or weighted plastic. The support base 15 beneficially weights approximately ten to fifteen pounds (10-15 lbs). This provides a weighted platform while still enabling easy carrying of the support base 15.

Figure 3:
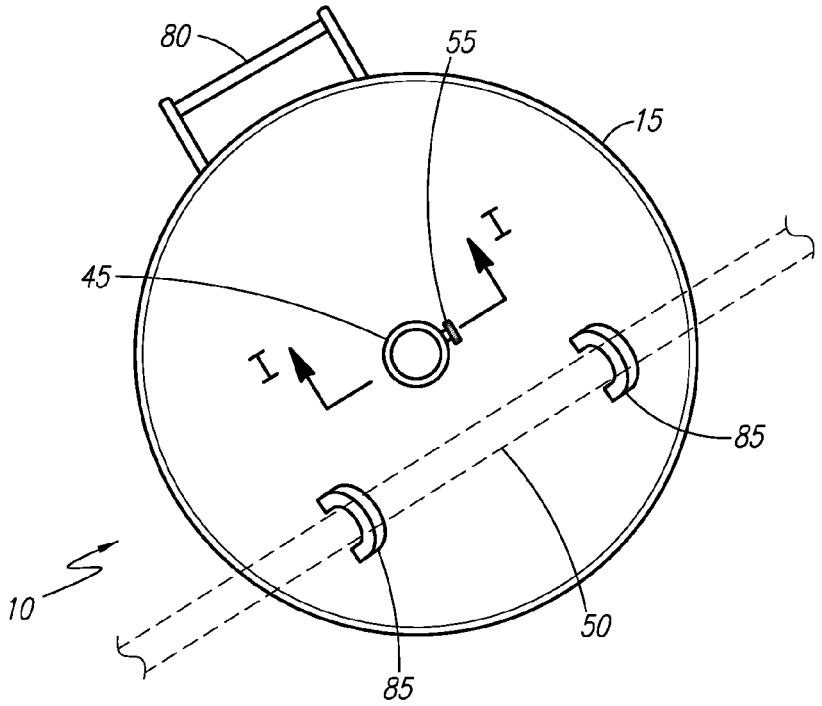
FIG. 3 is a top view of the support base 15 shown in FIG. 2.

FIG. 3 presents a top view of the support base 15. The carrying handle 80 is clearly shown. Also shown at the center of the support base 15 are the attachment sleeve 45 and the securing fastener 55. A pair of fastening clamps 85 is located on support base 15, beneficially opposite the carrying handle 80. The fastening clamps 85 hold the lower support tube 50 (partially shown via dashed lines for purposes of illustration) of the beach umbrella 25 when the lower support tube 50 is stored. The fastening clamps 85 enable easy transportation of the support system 10, including a beach umbrella 25 as one unit. Thus both the support system 10 and the beach umbrella 25 can be carried single handedly via the carrying handle 80.

Figure 4A:
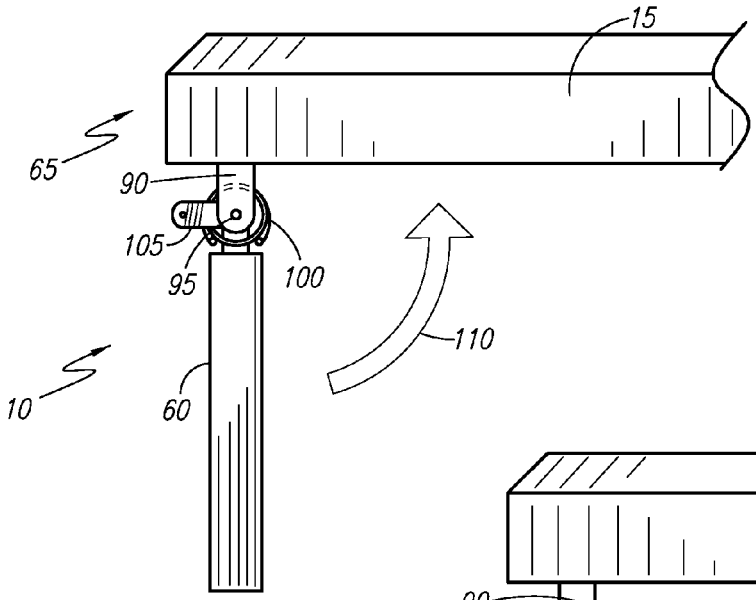
FIG. 4*a* is detailed view of a triangular-shaped appendages 60 used with the system 10 shown in a deployed state.
Figure 4B:
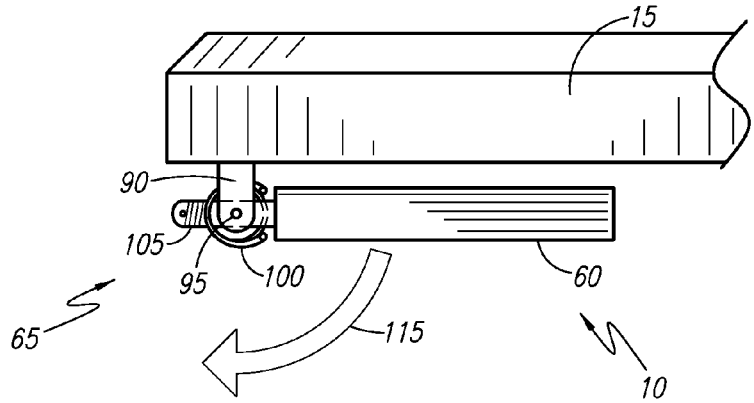
FIG. 4*b* is detailed view of the triangular-shaped appendages 60 shown stowed; and, FIG. 5 is a section view of the support base 15 taken along line I-I of FIG. 3.

FIGS. 4*a* and 4*b* show detailed views of the triangular-shaped appendages 60 and hinge assemblies 65. Each triangular-shaped appendage 60 is attached to the support base 15 by a hinge assembly 65. Each hinge assembly 65 includes a base mounting bracket 90, an appendage pivot 95, a spring assembly 100, and a release lever 105. Being spring-loaded the triangular-shaped appendages 60 can easily be placed in the deployed or active position as shown in FIG. 4*a*. When the release lever 105 is pressed, the triangular-shaped appendages 60 can each be folded against the bias provided by the spring assembly 100 to the bottom of the support base 15 as shown by a first travel path arrow 110. When fully folded the triangular-shaped appendages 60 are locked in place by the release lever 105. This is shown in FIG. 4*b*. Such folding reduces the likelihood of contact with objects, surfaces, or individuals when the support system 10 is being carried. When the release lever 105 releases the triangular-shaped appendages 60 the spring assembly 100 forces the triangular-shaped appendages 60 to pivot on the mounting bracket 90 using the appendage pivot 95 to move along the second travel path arrow 115 for deployment.

Figure 5:
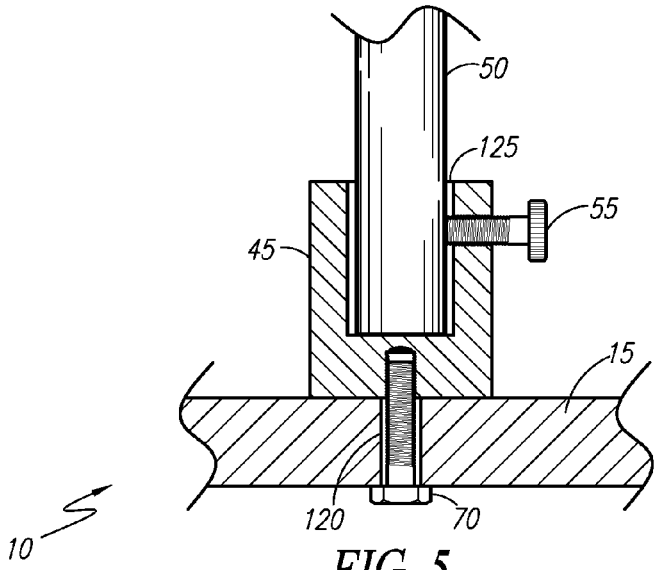

FIG. 5 presents a section view of the support base 15 taken along line I-I of FIG. 3 with the support base 15 shown in a partial view due to illustrative limitations. The attachment 70 passes through an opening 120 in the support base 15 to engage the attachment sleeve 45. Tightening the attachment 70 tightens the attachment sleeve 45 against the support base 15 such that the attachment sleeve 45 is held tight. The lower support tube 50 of the beach umbrella 25 (see FIG. 1) is placed into an upper opening 125 until it is fully seated. Finally, the securing fastener 55 is twisted until contacts the lower support tube 50 to hold it in place. The securing fastener 55 can be disengaged to allow for easy removal of the beach umbrella 25 for storage and transportation.

It is envisioned that other styles and configurations of the present invention can be easily incorporated into the teachings of the present invention, and only one particular configuration shall be shown and described for purposes of clarity and disclosure and not by way of limitation of scope.

It is envisioned that other styles and configurations of the present invention can be easily incorporated into the teachings of the present invention. While only one particular configuration is shown and described that is for purposes of clarity and disclosure and not by way of limitation of scope.

The preferred embodiment of the present invention can be used by the common user in a simple and effortless manner with little or no training. It is envisioned that the support system 10 would be constructed and used in general accordance with FIG. 1 through FIG. 5. The support base 15 along with its associated components could be used with a conventional beach umbrella 25 or manufactured and sold with a specific beach umbrella 25 for use with the support base 15. Should assembly of the beach umbrella 25 be pursued, standard and well-known manufacturing methods would be applied. In addition, the support base 15 can be used with other devices such as canopies that required a solid support.

In use the support system 10 would be carried to a desired spot on the beach, yard, park, or other location where shade and protection is desired. The lower support tube 50 attached to the beach umbrella 25 is disengaged from the fastening clamps 85 and set aside. Next, the triangular-shaped appendages 60 are deployed by releasing the release lever 105 and allowing the triangular-shaped appendages 60 to move along the second travel path arrow 115 as shown in FIG. 4*b*. That process is repeated for each of triangular-shaped appendages 60. The support base 15 is then placed into the grade by pushing it downward until the lower surface of the support base 15 is against the grade.

The lower support tube 50 is then inserted into the attachment sleeve 45 as shown in FIG. 5. The inserted lower support tube 50 is then secured in place the use the securing fastener 55. The beach umbrella 25 is then adjusted in height and angle by use of the height adjustment system 35 and the angle adjustment system 40, respectively. When use is complete the user would reverse the aforementioned process for storage.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A support system, comprising:
- a support base having a center, a top and a bottom;
- an attachment sleeve extending from said top;
- an attachment fastener passing through said support base to retain said attachment sleeve in position;
- a first triangular-shaped appendage for penetrating into a grade;
- a second triangular-shaped appendage for penetrating into a grade;
- a first hinge assembly attaching said first triangular-shaped appendage to said bottom; and,
- a second hinge assembly attaching said second triangular-shaped appendage to said bottom.

2. The support system according to claim 1, wherein said attachment fastener passes through said center.

3. The support system according to claim 1, further including a pole fastener threading into a side of said attachment sleeve.

4. The support system according to claim 3, wherein said pole fastener is a thumbscrew.

5. The support system according to claim 1, wherein said support base is substantially circular.

6. The support system according to claim 5, further including a hanging hook near the perimeter of said support base.

7. The support system according to claim 1, wherein said support base includes a carrying handle.

8. The support system according to claim 1, further including a third triangular-shaped appendage; a fourth triangular-shaped appendage, a third hinge assembly attaching said third triangular-shaped appendage to said bottom, and a fourth hinge assembly attaching said fourth triangular-shaped appendage to said bottom.

9. The support system according to claim 1, further including a beach umbrella having a lower support tube, a canopy, and a height adjustment system, wherein said lower support tube is inserted into said attachment sleeve.

10. A support system, comprising:
- a support base having a center, a top and a bottom;
- an attachment sleeve extending from said top;
- an attachment fastener passing through said support base to retain said attachment sleeve in position;
- a first triangular-shaped appendage;
- a second triangular-shaped appendage;
- a third triangular-shaped appendage;
- a fourth triangular-shaped appendage;
- a first hinge assembly attaching said first triangular-shaped appendage to said bottom;
- a second hinge assembly attaching said second triangular-shaped appendage to said bottom;
- a third hinge assembly attaching said third triangular-shaped appendage to said bottom; and,
- a fourth hinge assembly attaching said fourth triangular-shaped appendage to said bottom.

11. The support system according to claim 10, wherein said attachment fastener passes through said center.

12. The support system according to claim 11, further including a pole fastener threading into a side of said attachment sleeve.

13. The support system according to claim 12, wherein said pole fastener is a thumbscrew.

14. The support system according to claim 10, wherein said support base is substantially circular.

15. The support system according to claim 14, further including a hanging hook near the perimeter of said support base.

16. The support system according to claim 15, wherein said support base includes a carrying handle.

17. The support system according to claim 10, further including a beach umbrella having a lower support tube, a canopy, and a height adjustment system, wherein said lower support tube is inserted into said attachment sleeve.

18. The support system according to claim 10, further including a pair of fastening clamps attached to said support base, said fastening clamps for attaching a pole to said support base.

* * * * *